US006234749B1

(12) United States Patent
Hasegawa et al.

(10) Patent No.: US 6,234,749 B1
(45) Date of Patent: May 22, 2001

(54) CENTRIFUGAL COMPRESSOR

(75) Inventors: Kazumitsu Hasegawa, Narashino; Takashi Hokari, Akishima; Shinichi Ozaki, Kunitachi; Kanji Majima, Yokohama, all of (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 09/375,631

(22) Filed: Aug. 17, 1999

(30) Foreign Application Priority Data

Aug. 21, 1998 (JP) ..... 10-235535
Nov. 30, 1998 (JP) ..... 10-339698

(51) Int. Cl.[7] ..... F04D 29/08

(52) U.S. Cl. ..... 415/173.4; 415/122.1; 417/244; 417/423.5

(58) Field of Search ..... 415/173.4, 174.4, 415/196, 197, 200, 122.1, 93, 101, 199.1, 199.2, 199.3; 417/244, 423.5; 277/415, 936, 946

(56) References Cited

U.S. PATENT DOCUMENTS 4,371,180 * 2/1983 Case et al. ..... 277/230
4,431,698 * 2/1984 Case et al. ..... 428/244
5,171,027 * 12/1992 Domkowski et al. ..... 277/173
5,472,315 * 12/1995 Alexander et al. ..... 415/173.4
5,785,493 * 7/1998 Ojima et al. ..... 415/200
5,975,845 * 11/1999 Ball ..... 415/173.4
5,980,203 * 11/1999 Zatorski et al. ..... 415/174.4
6,039,535 * 3/2000 Kobayashi et al. ..... 415/173.4
6,050,780 * 4/2000 Hasegawa et al. ..... 417/423.5

FOREIGN PATENT DOCUMENTS 1 485 115 9/1967 (FR) .
47-50685 * 12/1972 (JP) ..... 415/197
06307250A 11/1994 (JP) .

* cited by examiner

*Primary Examiner*—Christopher Verdier
(74) *Attorney, Agent, or Firm*—McCormick, Paulding & Huber LLP

(57) ABSTRACT

A centrifugal compressor (1) including a single rotating shaft (5), a first (upstream) and second (downstream) impellers (2, 3) mounted on ends of the rotating shaft (5) respectively, and a casing (4) for accommodating these impellers. An air path (35) is provided for introducing an air pressurized by the upstream impeller (2) to the downstream impeller (3). An abradable layer (34) is embedded in the casing inner wall (4) such that it faces and is cut by the second downstream impeller (3). The expensive abradable layer (34) is only provided for the downstream impeller (3) since the effect of the abradable layer (34) is significant when provided for the downstream impeller.

17 Claims, 7 Drawing Sheets

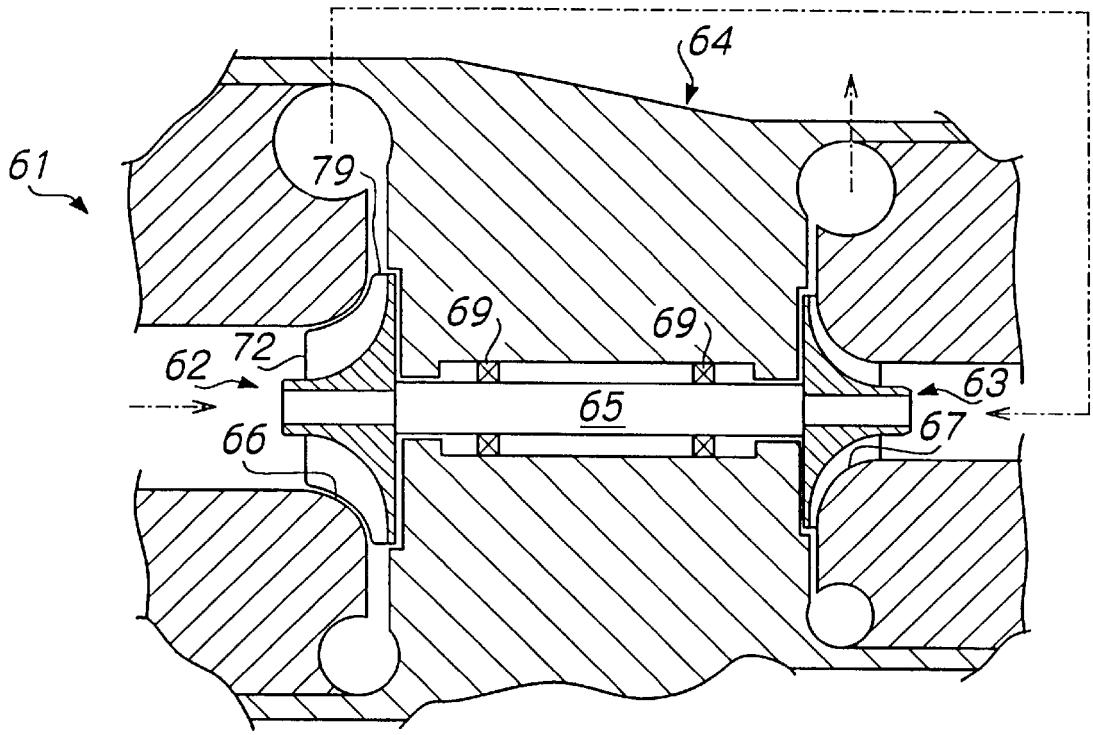
FIG. 6
PRIOR ART
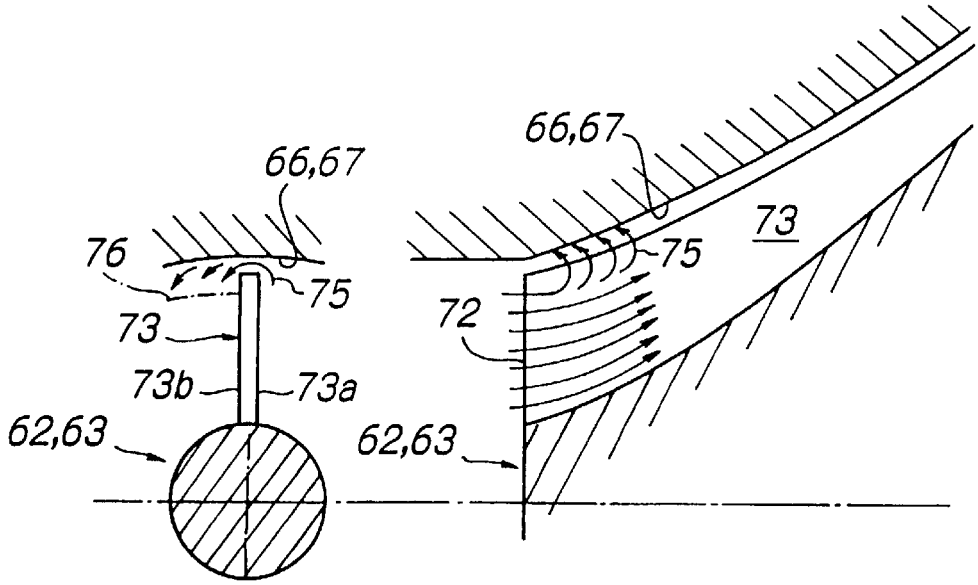
FIG.7A
PRIOR ART
FIG.7B
PRIOR ART

CENTRIFUGAL COMPRESSOR

BACKGROUND OF THE INVENTION

1. Field of the Invention

The present invention relates to a centrifugal compressor, and more particularly to a centrifugal compressor having an abradable layer embedded in a compressor casing inner wall and cut by a rotating impeller.

2. Description of the Related Art

Various centrifugal compressors are known in the art. One type of centrifugal compressor includes a casing, an impeller housed in the casing, and an abradable layer provided on an inner surface of the casing such that it is cut by the impeller rotating in the casing. As the compressor is activated and the impeller rotates, the clearance between the impeller and the abradable layer is eventually adjusted to an optimum value. This type of centrifugal compressor improves an operation efficiency. Such centrifugal compressor is disclosed in, for example, Japanese Patent Application, Laid-Open Publication No. 6-257454 published on Sep. 13, 1994.

Referring to FIG. 6 of the accompanying drawings, illustrated is another conventional centrifugal compressor. This is a multi-stage centrifugal compressor 61 including a casing 64 and two impellers 62 and 63 mounted on ends of a common rotating shaft 65. If the teaching of Japanese Patent Application, Laid-Open Publication No. 6-257454 is applied to the illustrated centrifugal compressor 61, two abradable layers (not shown) will be embedded in the casing inner walls 66 and 67 in the vicinity of both the impellers 62 and 63 respectively.

However, the abradable layer is expensive so that providing the abradable layers for the two impellers 62 and 63 will raise a manufacturing cost of the compressor 61.

Incidentally, the abradable layer taught in Japanese Patent Application, Laid-Open Publication No. 6-257454 also extends along the impeller 62, 63 from its front edge 72 to rear edge 79.

SUMMARY OF THE INVENTION

It is an object of the present invention to provide a multi-stage centrifugal compressor which can realize both cost reduction and efficiency improvement.

It is another object of the present invention to provide a centrifugal compressor which can realize both surge limit extension toward the lower flow rate range and compression efficiency improvement.

According to one aspect of the present invention, there is provided a centrifugal compressor including a single rotating shaft, a plurality of impellers mounted on the rotating shaft, an air path for introducing an air accelerated by a first (or upstream) impeller to subsequent (or downstream) impellers, a casing for accommodating the plurality of impellers, and an abradable layer provided in the casing such that it faces the subsequent impellers and is cut by these impellers. This compressor is a single-shaft multi-stage centrifugal compressor. The abradable layers are only provided for the downstream impellers since the effect of the abradable layer is significant when provided for the downstream impellers but not significant when provided for the upstream impeller. When compared with a centrifugal compressor having abradable layers for all the impellers, the compressor according to the invention demonstrates substantially the same efficiency while reducing the manufacturing cost. The abradable layer is expensive so that eliminating the abradable layer for the first upstream impeller contributes to cost reduction.

The inventors made experiments on a multi-stage centrifugal compressor equipped with abradable layers and learned by these experiments that providing the abradable layer only for the downstream impeller will be sufficient. In other words, it is unnecessary to provide an abradable layer for the upstream impeller.

In the arrangement shown in FIG. 6, the rotational speed of the upstream impeller 62 is equal to that of the downstream impeller 63 since these impellers 62 and 63 are mounted on the mutual shaft 65. Therefore, the volumetric flow rate of the impeller 63 is smaller than that of the impeller 62. As a result, as illustrated in FIG. 8 of the accompanying drawings, the exit width W2 of the downstream impeller 63 becomes smaller than that W1 of the upstream impeller 62. When the impeller outlet width W becomes smaller, the impeller-casing clearance $\delta$ becomes larger relatively. Accordingly, the ratio $\delta/W$ indicative of influence of leakage by the clearance $\delta$ at the impeller outlet width W is greater for the downstream impeller 63 than the upstream impeller 62 when $\delta 1=\delta 2$.

Thus, the inventors concluded that providing the abradable layer only for the downstream impeller 63 is enough in view of efficiency improvement since the influence of leakage by the clearance $\delta$ is relatively great for the downstream impeller 63 and relatively small for the upstream impeller 62. Of course, dispensing with one of the two expensive abradable layers will also result in manufacturing cost reduction.

Referring back to FIG. 6, the rotating shaft 65 is supported by bearings 69 such that it is allowed to slide in its axial direction to a certain extent in order to suppress vibrations and/or for other reasons. Since the impellers 62 and 63 are mounted on the opposite ends of the rotating shaft 65 with the backs of these impellers facing each other, a high speed flow of air passing the downstream impeller 63 causes the impeller 63 to be attracted toward the casing inner wall 67. Therefore, the shaft 65 moves to the right in the illustration within the tolerated range.

As a result, even if an abradable layer was provided on an inner wall 66 of the casing 64 near the upstream impeller 62, the impeller 62 would rotate without contacting the abradable layer since the rotating shaft 65 would be caused to move to the right during operation and the impeller 62 would leave the abradable layer. On the contrary, the downstream impeller 63 is forced against the casing inner wall 67 during operation so that this abradable layer demonstrates its effect in a significant manner.

From this fact also, it can be said that providing the abradable layer only for the downstream impeller 63 suffices in terms of efficiency improvement.

The compressor may only have two impellers, these impellers may be mounted on the mutual shaft such that their backs face each other, and the abradable layer may be provided for the single downstream impeller only. The rotating shaft may be supported such that it is slidable in an axial direction of the shaft within a certain range (e.g., 0.2 mm) relative to the casing.

A pinion may be mounted on the rotating shaft, a large gear may be provided to engage the pinion, and a drive motor may be provided to activate the large gear.

The compressor casing may include an inducer block which defines an intake air path for the downstream impeller, and the abradable layer may be provided at a front end of the inducer block. The abradable layer may be made from Teflon™ mixed with silica (quartz) or mica.

According to the second aspect of the present invention, there is provided a centrifugal compressor including a casing, an impeller housed in the casing, and an abradable layer embedded in the casing inner wall and subjected to impeller blades such that it extends in the range of M–m, which M and m satisfy the equation of $0.2 \leqq m/M \leqq 0.4$ where m represents that length on the casing inner wall which corresponds to length of the impeller blade from its front edge to an arbitrary position, and M represents that length on the casing inner wall which corresponds to length of the impeller blade from the front edge to the rear edge.

With this design, there is no abradable layer near the front edge of the impeller blade. Specifically, if the impeller blade length is expressed 100%, then the abradable layer does not extend in the 20–40% area in the vicinity of the front edge of the impeller blade. Consequently, a certain clearance (e.g., 0.2 to 0.4 mm) is formed between the casing inner wall and the impeller blade. On the other hand, there is substantially no clearance between the casing inner wall defined by the abradable layer and the impeller blade when apart from the front edge of the impeller blade. Thus, the clearance flow occurs near the front edge of the impeller blade but is prohibited at a certain distance from the front edge of the impeller blade. This design enables both surge limit expansion toward the lower flow rate range and efficiency improvement.

This structure was developed by the following finding out by the inventors. Referring to FIGS. 7A and 7B of the accompanying drawings together with FIG. 6, the inventors learned that a flow of air 75 over the impeller blade 73 between the casing inner wall 66, 67 and the impeller blade 73 (referred to as "clearance flow") is hindered near the blade front edge 72 when the impeller blade 73 is completely subjected to the abradable layer from its front edge 72 to rear edge 79. In such a case, it is difficult to expand the surge limit toward the lower flow rate range.

The clearance flow is a phenomenon that part of the air is forced to the suction surface 73*b* side of the impeller blade 73 from the pressure surface 73*a* side through a clearance formed between the blade 73 and the casing inner wall 66, 67 as indicated by the arrows 75. The clearance flow 75 makes the air flow path on the suction surface 73*b* side narrower as indicated by the imaginary line 76. This raises the speed of air in the main flow path and suppresses separation (break away). Consequently, the clearance flow can expand the surge limit toward the lower flow rate range.

If the abradable layer faces the impeller blade 73 from the front edge 72 to the rear edge 79, then the clearance near the front edge 72 of the impeller 62, 63 becomes substantially zero so that the clearance flow hardly occurs. In this case, it is difficult to extend the surge limit toward the lower flow rate range.

If no abradable layer is provided, a certain clearance is formed between the impeller blade 73 and casing inner wall 66, 67 as illustrated in FIGS. 7A and 7B so that the clearance flow occurs as indicated by the arrows 75. This lowers of the surge limit. However, the clearance flow is a kind of leakage so that the compression efficiency is inevitably deteriorated.

In this invention, therefore, the abradable layer does not exist near the front edge of the impeller blade but exists afterwards.

The abradable layer projects from the casing inner wall surface at the upstream end thereof. It may project stepwise or gently. The abradable layer may be made from Teflon™ mixed with quartz or mica.

A diffuser may be provided downstream of the abradable layer.

BRIEF DESCRIPTION OF THE DRAWINGS

FIG. 6 illustrates a schematic sectional view of a conventional multi-stage centrifugal compressor;

FIG. 7A is an enlarged fragmentary front cross sectional view of the compressor shown in FIG. 6, particularly illustrating one impeller and an adjacent casing inner wall; and FIG. 7B is a lateral cross sectional view of the compressor corresponding to FIG. 7A;

DETAILED DESCRIPTION OF THE INVENTION

Now, embodiments of the present invention will be described in reference to FIGS. 1 to 5 of the accompanying drawings.

First Embodiment:

One embodiment according to the present invention will be described by referring to FIGS. 1 and 2.

Figure 1:
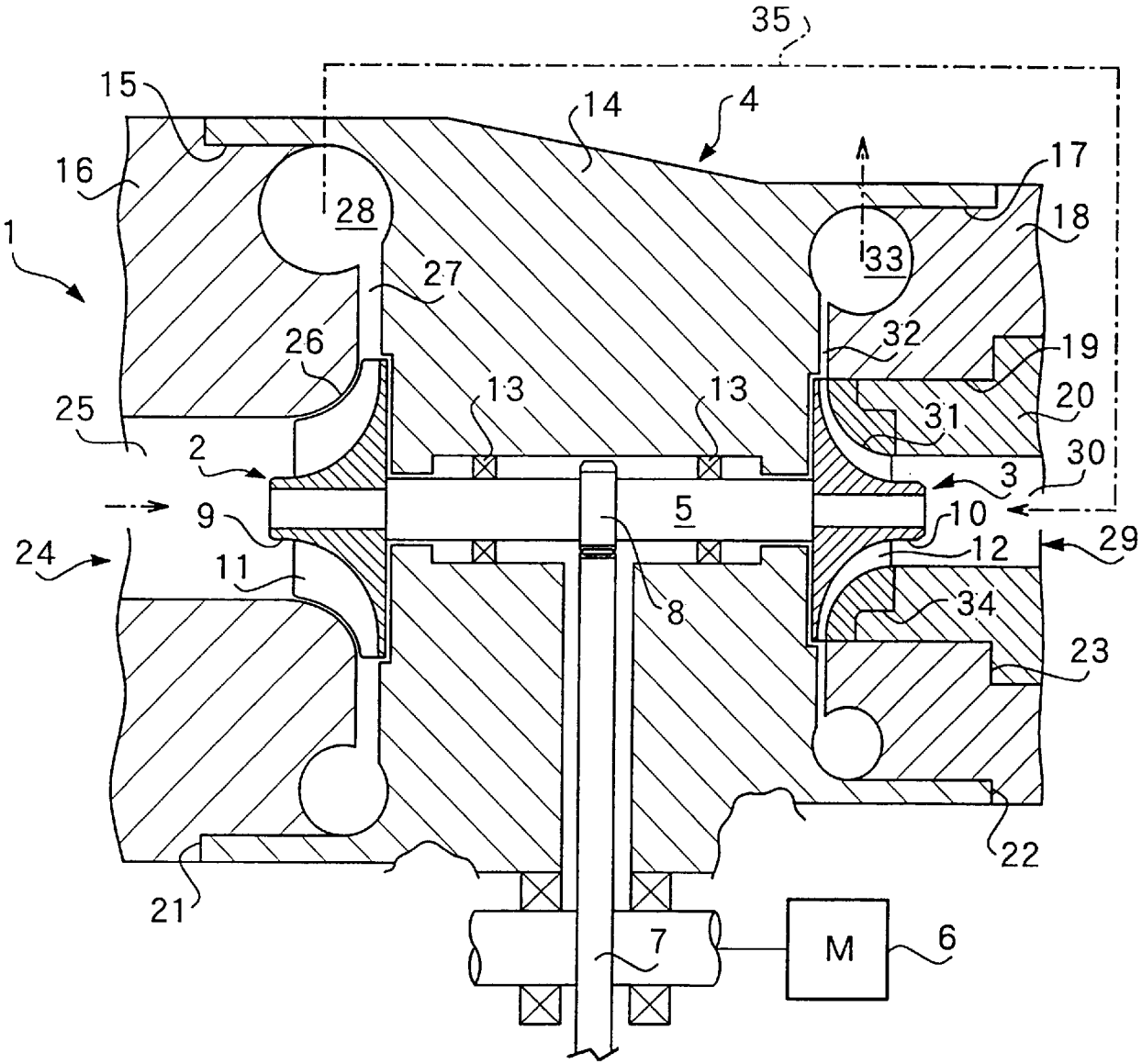
FIG. 1 illustrates a sectional view of a multi-stage centrifugal compressor according to a first embodiment of the present invention.

As illustrated in FIG. 1, a two-stage centrifugal compressor 1 includes a casing 4 and two impellers 2 and 3 housed in the casing 4. In the casing 4, a rotating shaft 5 is supported by bearings 13. The rotating shaft 5 is journaled such that it can slightly (about 0.2 mm) slide in the axial direction for suppression of vibrations and/or for other reasons. The shaft 5 has a pinion 8 on its approximate center. The pinion 8 engages with a large gear 7. A motor 6 is provided to drive the large gear 7. Rotations of the motor 6 are transmitted to the large gear 7 and pinion 8 in turn, thereby rotating the shaft 5.

The first (or upstream) impeller 2 and second (or downstream) impeller 3 are mounted on ends of the rotating shaft 5 respectively such that their backs are opposed each other. Each impeller 2, 3 includes a conical rotor 9, 10, and a plurality of blades 11, 12 radiantly extending from the rotor 9, 10. As illustrated in the right half of FIG. 2, the blades 11, 12 may have full and half blades arranged alternately. Alternatively, as illustrated in the left half of FIG. 2, the blades 11, 12 may include the full length ones only.

Referring back to FIG. 1, the casing 4 includes a center block 14 which supports the bearing 13 therein, the first block 16 fitted in the left opening 15 of the center block 14, the second block 18 fitted in the right opening 17 of the center block, and an inducer block 20 fitted in the right opening 19 of the right block 18. The blocks 16, 18 and 20 are positioned by steps 21, 22 and 23 respectively.

The center block 14 and left block 16 define an inducer 25 for the upstream compressor 24, a casing inner wall 26 subjected to the first impeller 2, a diffuser 27, and a scroll chamber 28. Likewise, the center block 14, right block 18 and inducer block 20 define a second inducer 30 for the downstream compressor 29, a casing inner wall 31 subjected to the second impeller 3, a second diffuser 32 and a second scroll chamber 33.

Figure 2:
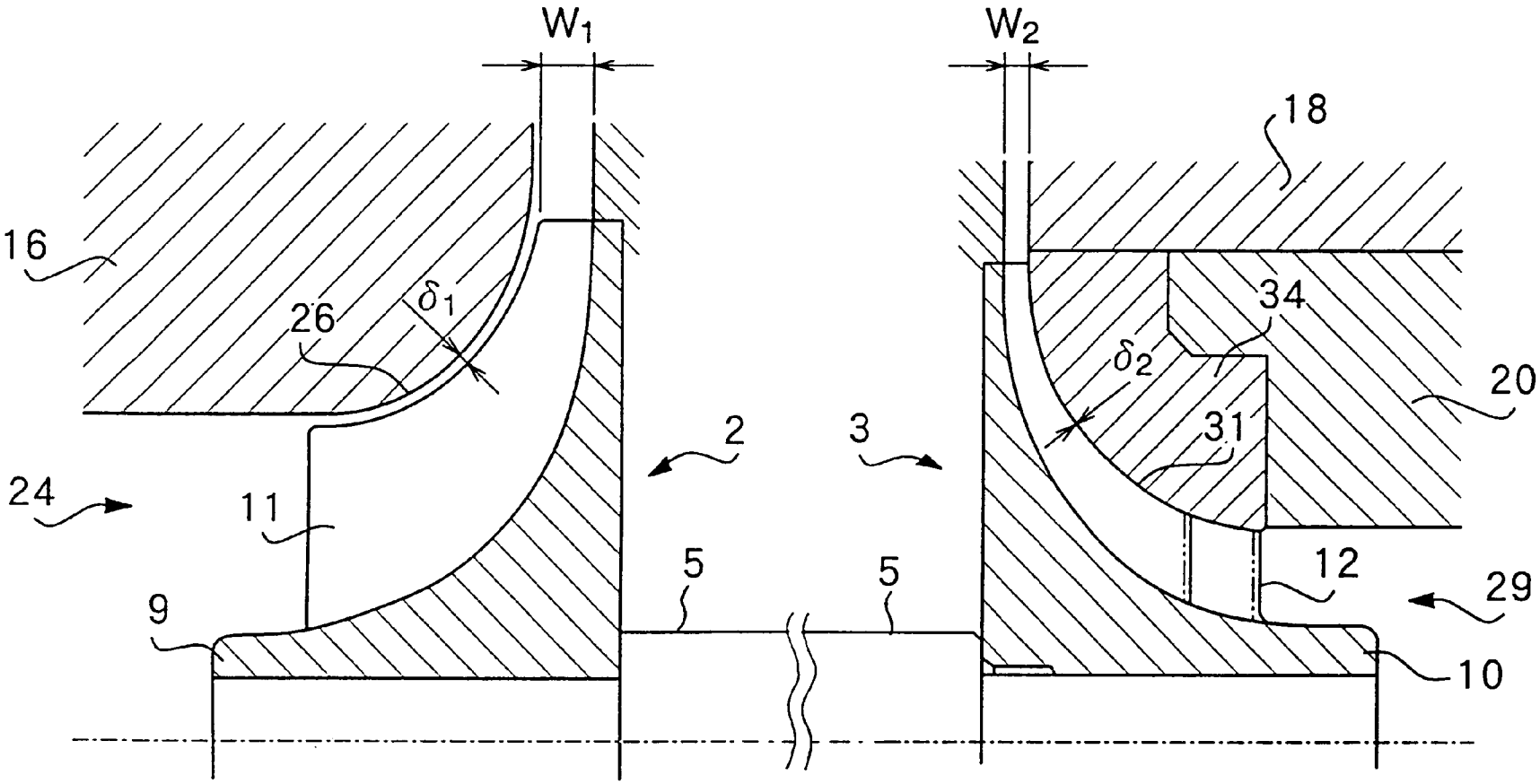
FIG. 2 illustrates an enlarged fragmentary sectional view of the compressor shown in FIG. 1.

Between the upstream impeller 2 (specifically, its blades 11) and associated casing inner wall 26, formed is a clearance δ1 (about 0.2 mm) as illustrated in the left half of FIG. 2. No abradable layer is buried in the casing inner wall 26. On the other hand, as shown in the right half of FIG. 2, a clearance δ2 between the right impeller 3 (specifically its blades 12) and the associated casing inner wall 31 is set to substantially zero. An abradable layer 34 is provided in this casing inner wall 31.

The abradable layer 34 is made from, for instance, Teflon™ mixed with quartz or mica. The abradable layer 34 has a block form and is attached to a front end (left end in the illustration) of the inducer block 20. The abradable layer 34 has a contour which gently contacts the blades 12 of the right impeller 3 at the beginning. As the centrifugal compressor 1 is operated, the impeller blades 12 rotate and cut the abradable layer 34 so that the abradable layer 34 will have a contour conforming to the impeller blades 12, and accordingly the clearance δ2 will become substantially zero.

Now, an operation of the centrifugal compressor 1 will be described.

An air is sucked into the inducer 25 of the first compressor 24, accelerated by the impeller 2 and converted to pressure (pressurized air) by the diffuser 27. This pressurized air is rectified by the scroll chamber 28 and introduced to the inducer 30 of the second compressor 29 through an air path 35. In the second compressor 29, the air is further pressurized by the impeller 3, diffuser 32 and scroll chamber 33, like in the first compressor 24, and discharged.

Since the two impellers 2 and 3 are mounted on the single shaft 5, the rotational speed of the impeller 2 is equal to that of the impeller 3. Thus, the volumetric flow rate of the downstream impeller 3 is smaller than that of the upstream impeller 2, and as illustrated in FIG. 2, the outlet width W2 of the downstream impeller 3 is smaller than that W1 of the upstream impeller 2.

As the impeller outlet width W becomes smaller, the impeller-casing clearance δ becomes relatively larger. As a result, the ratio δ/W representing the influence of leakage due to the clearance δ at the impeller exit width W is greater for the downstream impeller than the upstream impeller when δ1=δ2.

In the illustrated embodiment, therefore, the abradable layer 34 is provided in the downstream compressor 29 since the clearance δ2 is more influencing than the clearance δ1. No abradable layer is provided in the upstream compressor 24 since the leakage due to the clearance δ1 is relatively small.

As described earlier, the rotating shaft 5 is supported such that it can move slightly in the axial direction (e.g., about 0.2 mm) for suppression of vibrations and other reasons. As illustrated in FIG. 1, therefore, when the two impellers 2 and 3 are mounted on the single shaft 5 with their backs being opposed each other, the high speed air flowing through the downstream impeller 3 attracts the impeller 3 toward the casing inner wall (specifically, toward the abradable layer 34), and accordingly the rotating shaft 5 is shifted to the right in the drawing to a certain extent.

Therefore, even if an abradable layer was also provided on the casing inner wall 26 subjected to the first impeller 2, the shaft 5 would move to the right during operation and the impeller 2 would be separated from the abradable layer. Thus, the impeller 2 would not contact or cut the abradable layer while rotating. In the second compressor 29, contrarily, the impeller 3 is forced against the casing inner wall 31 so that the abradable layer 34 can demonstrate its function appropriately.

From this point of view also, the abradable layer 34 is only provided for the second compressor 29.

In this embodiment, the single-shaft two-stage centrifugal compressor 1 has two compressors 24 and 29, but the abradable layer 34 is only provided for the second compressor 29 since the advantage obtained by providing the abradable layer is considerably greater when it is provided for the second impeller 3 than when it is provided for the first compressor 24. When compared with a compressor having abradable layers for both the compressors 24 and 29, the illustrated compressor 1 can be manufactured at a lower cost without substantially deteriorating the efficiency. Since the abradable layer is expensive, eliminating one of the two abradable layers greatly contributes to cost reduction.

In this manner, the centrifugal compressor 1 can realize both cost down and efficiency improvement in the best compromised manner.

Second Embodiment:

Another embodiment according to the present invention will now be described in reference to FIGS. 3 through 5.

Figure 3:
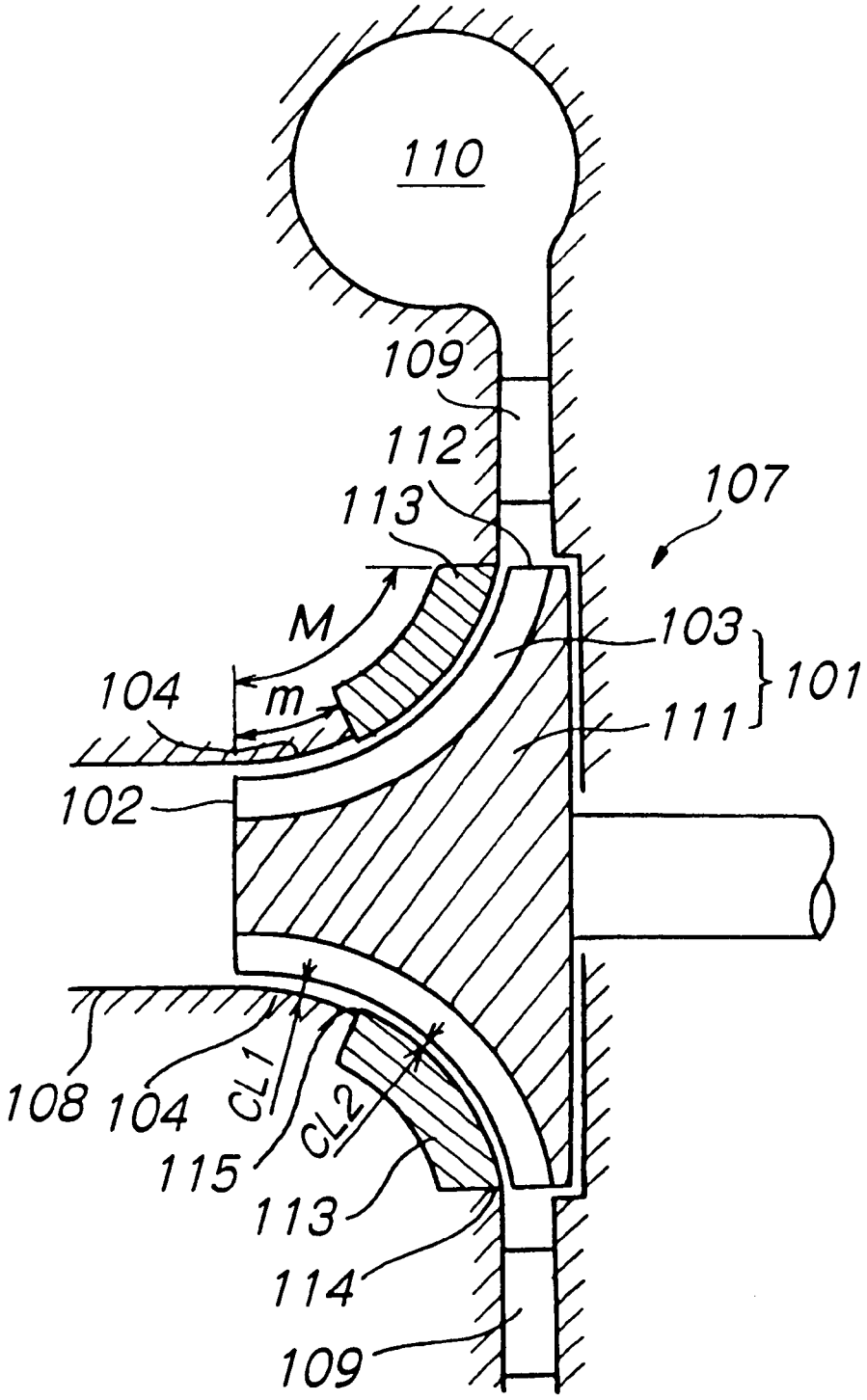
FIG. 3 illustrates a cross sectional view of a centrifugal compressor according to the second embodiment.

Referring first to FIG. 3, a centrifugal compressor 107 for compressing an air includes an impeller 101 driven by a motor or the like (not shown), a casing 104 for the impeller 101, an air pipe 108 for introducing the air into the casing 104, a diffuser 109 for decelerating the air discharged from the impeller 101 and converting it to pressurized air, and a scroll chamber 110 for rectifying the air from the diffuser 109 and feeding it to the downstream.

The impeller 101 includes a rotor 111 of conical shape, and a plurality of blades 103 radiantly extending from the rotor 111. The casing 104 generally has a conical configuration to accommodate the impeller 101 with a predetermined clearance CL1. In this embodiment, the clearance CL1 is about 0.2 to 0.4 mm. The diffuser 109 may have vanes or no vanes.

The major feature of this embodiment lies in that an abradable layer 113 is embedded in the casing inner wall 104 in the range of M–m, which M and m satisfy the following equation:

$$0.2 \leq m/M \leq 0.4$$

where m represents that length of the casing inner wall surface which corresponds to length of the impeller 101 (or blade 103) from its front edge 102 to an arbitrary position, and M represents that length of the casing inner wall surface which corresponds to length of the impeller 101 from the front edge 102 to the rear edge 112.

In other words, there is no abradable layer in an area close to the impeller front edge 102. Specifically, if the whole area from the impeller front edge 102 to the rear edge 112 is expressed 100%, then the abradable layer 113 does not extend in the 20% to 40% area in the vicinity of the impeller front edge 102. In this area, a clearance CL1 of about 0.2 to 0.4 mm is formed between the casing inner wall 104 and the impeller blade 103. The abradable layer 113 only extends in the remaining area, relatively on the rear edge side, and a clearance CL2 of substantially zero is left between the abradable layer 113 and the impeller blade 103. It should be noted that the clearance CL2 in FIG. 3 is depicted in an exaggerated manner.

Because the clearance CL1 is left near the impeller front edge 102, occurrence of the clearance flow 105 over the impeller blades 103 (FIGS. 4A and 4B) is ensured in the m area. On the other hand, since the clearance CL2 is substantially zero, no clearance flow occurs in the M-m area.

The abradable layer 113 is made from, for example, Teflon™ mixed with quartz or mica. At the initial setting of the compressor 107, the second clearance CL2 is designed to zero. During operation, however, the abradable layer 113 is cut by the rotating blades 103 of the impeller 101 so that it will eventually have a configuration in conformity with the impeller 101. The clearance CL2 ultimately becomes substantially zero and is maintained. The rear end 114 of the abradable layer 113 is coplanar to the casing inner wall surface and smoothly continues to the diffuser 109 in order to prevent separation. On the other hand, the front (or upstream) end 115 of the abradable layer 113 slightly projects from the casing inner wall 104. It should be noted that although the abradable layer 113 defines a stepwise front end 115 in the illustrated embodiment, it may have a gentle slope to prevent separation.

The operation of the centrifugal compressor 107 will now be described.

Since the clearance CL1 exists between the impeller 101 and the casing inner wall in the vicinity of the front end 102 of the impeller 101, the clearance flow 105, which enlarges the surge limit to the lower flow rate side, takes place through the clearance CL1. On the other hand, since there is substantially no clearance between the impeller 101 and the abradable layer 113 (casing inner wall defined by the abradable layer) in other areas of the impeller 101, no leakage flow (clearance flow), which deteriorates compression efficiency (adiabatic efficiency) of the compressor 107, takes place through the clearance CL2. Taking advantage of these two phenomena, the present invention can realize both extension of the surge limit toward the lower flow rate range and efficiency improvement in the best compromised manner.

Figure 4A:
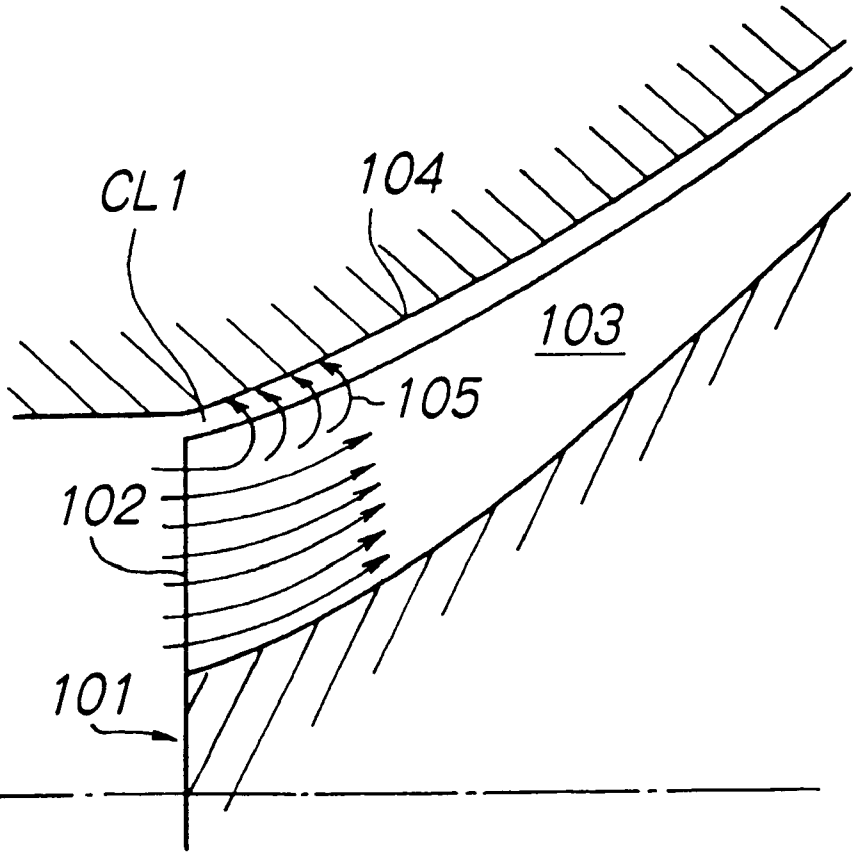
FIG. 4A is an enlarged fragmentary cross sectional view of the compressor shown in FIG. 3.
Figure 4B:
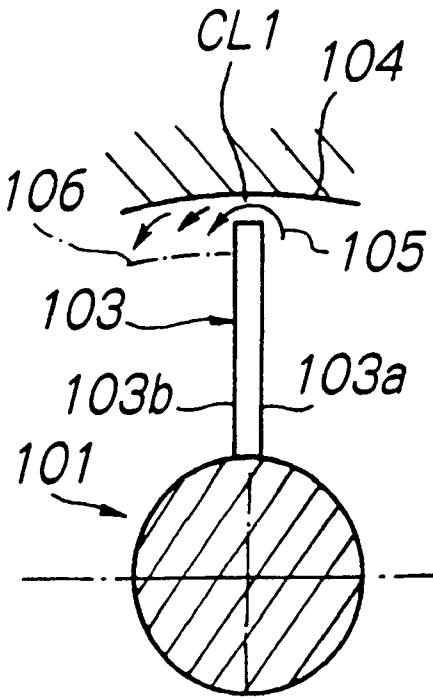
FIG. 4B is a front cross sectional view of the compressor shown in FIG. 4A.

As the clearance flow 105 occurs, the air flow path on the suction face 103*b* side is in effect reduced as indicated by the imaginary line 106 in FIGS. 4A and 4B. Therefore, the speed of air in the main flow path directed to the impeller 101 is raised, and in turn the separation is suppressed and the surge limit extends to the lower flow rate area.

Since the second clearance CL2 is substantially zero because of existence of the abradable layer 113, it is possible to prevent the air, which flows in from the impeller front edge 102 and is accelerated as it advances along the pressure surface 103*a* of the blade 103, from leaking to the blade suction surface 103*b*. As a result of preventing the leakage of accelerated flow of air, it is feasible to prevent the compression efficiency (adiabatic efficiency) from lowering.

According to the invention, therefore, both extension of the surge limit toward the lower flow rate range and efficiency improvement are achieved. The inventors confirmed these facts by experiments. The result of experiments is diagramed in FIG. 5.

In this diagram, the diamond indicates the case where no abradable layer is provided (i.e., m/M=1), the square indicates the case where m/M=0, i.e., the abradable layer 113 extends the whole M area, the triangle indicates the case where m/M=0.3, i.e., the abradable layer 113 does not extend in the 30% area in the vicinity of the front end 102 of the blade 103, and the circle indicates the case where m/M=0.5, i.e., the abradable layer 113 extends along the rear half of the impeller blade 103.

Figure 5:
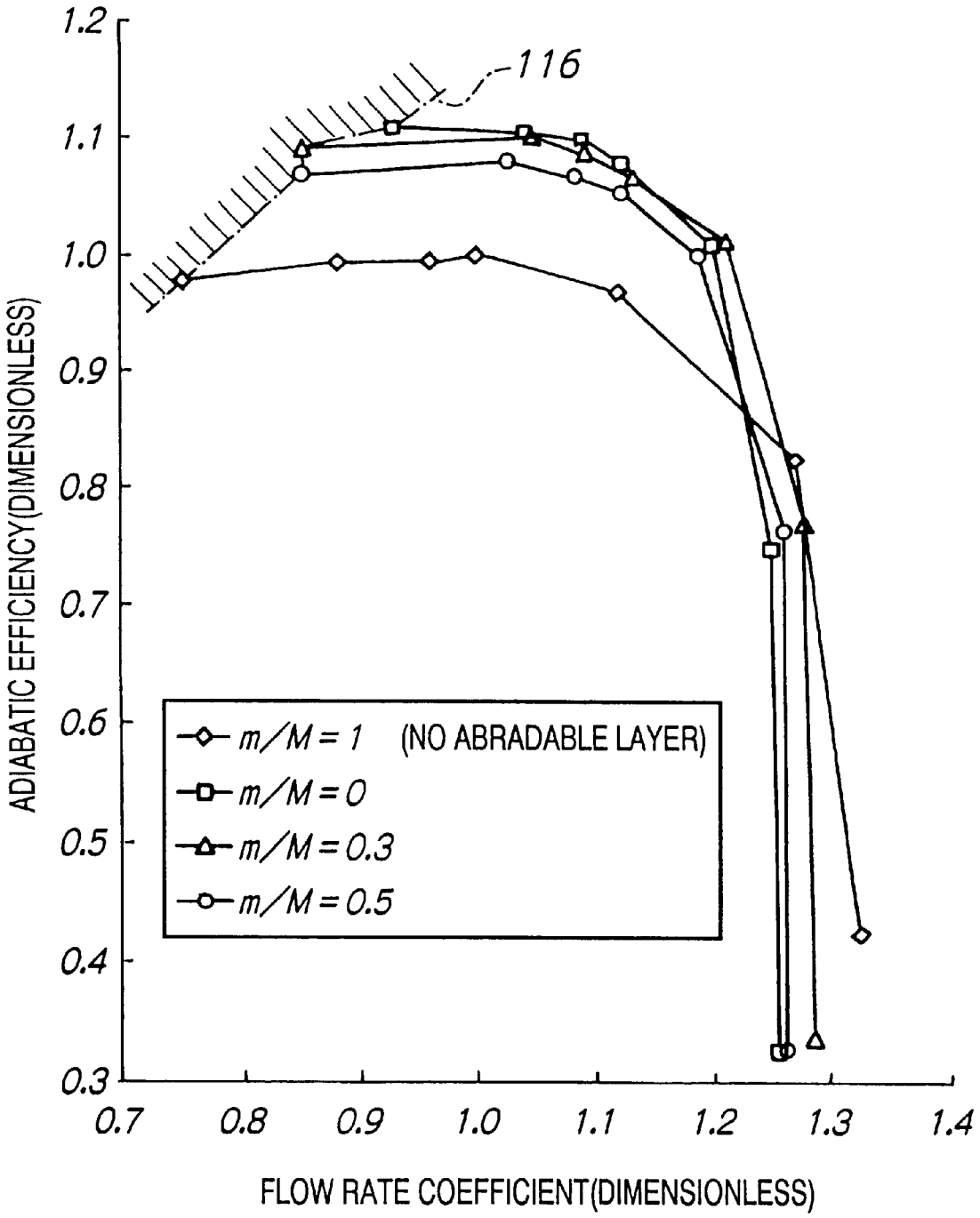
FIG. 5 illustrates the result of experiments conducted to find out the effect of the abradable layer with respect to the compressor efficiency and surge limit.
Figure 8:
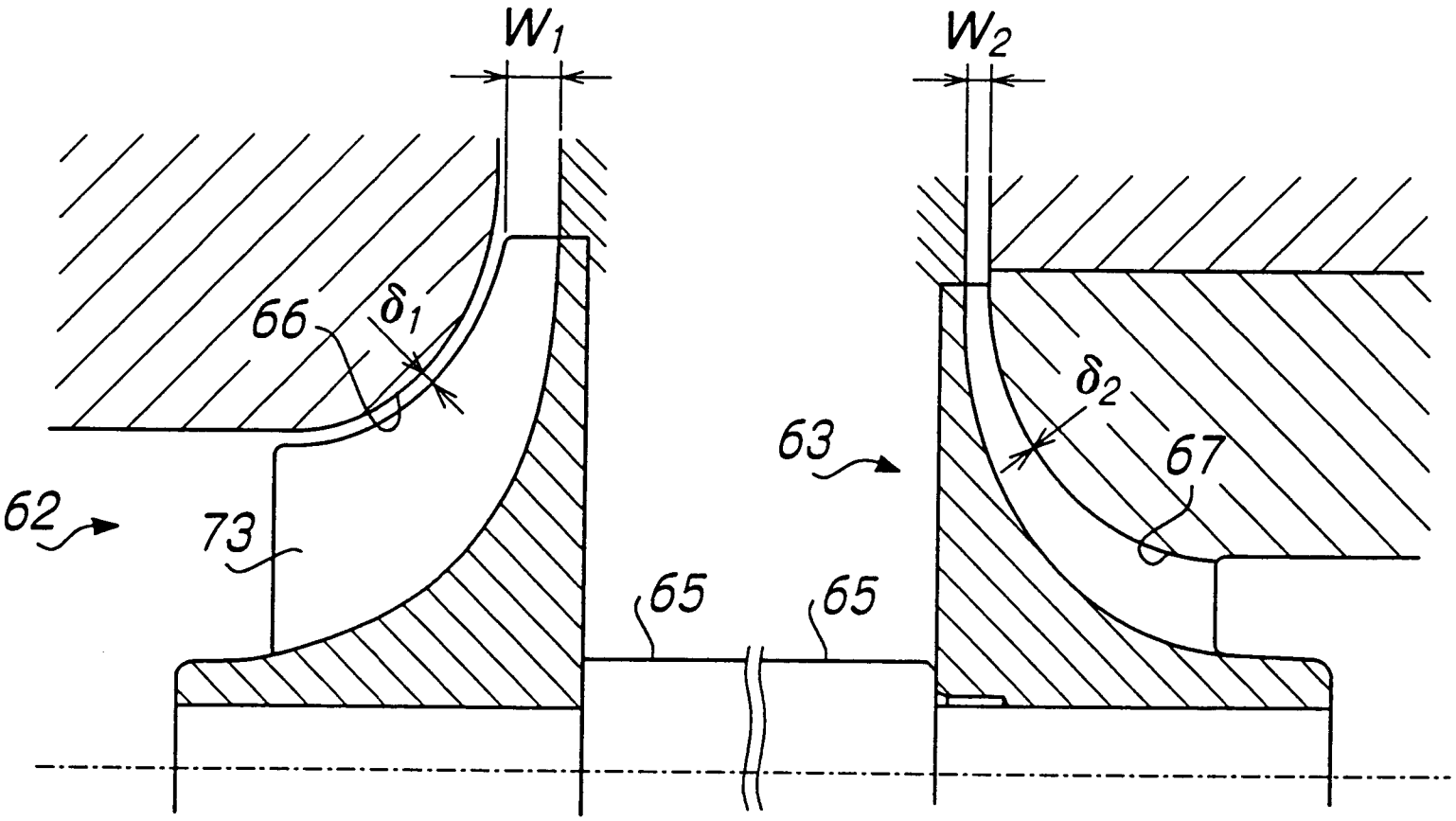
FIG. 8 PRIOR ART
FIG. 8 illustrates an enlarged fragmentary sectional view of the compressor shown in FIG. 6, particularly illustrating two impellers and adjacent casing inner walls.

As understood from FIG. 5, the efficiency is maximum when the abradable layer 113 extends over the whole impeller blade (m/M=0) and minimum when there is no abradable layer (m/M=1). This is because the leakage flow which causes efficiency deterioration is the smallest in the former case and the largest in the latter case. On the other hand, the surge limit most extends to the lower flow rate range when no abradable layer is provided (m/M=1) and least when the abradable layer 113 extends along the entire length of the impeller blade 103 (m/M=0). This is because the clearance flow which allows the surge limit to expand toward the lower flow rate range is the maximum when m/M=1 and the minimum when m/M=0. In FIG. 5, the imaginary line 116 indicates the surge limit.

When the curve of m/M=0.3 is compared with that of m/M=0, the efficiency of the former curve is substantially the same as the latter curve. However, the curve of m/M=0.3 has a surge limit more extended toward the lower flow rate range. Thus, it can be concluded that the structure with the curve of the triangle is a well balanced one. In the invention, therefore, the range between 0.2 and 0.4 is chosen as an optimum range for m/M (±10% deviation from the value of 0.3).

The experiments were carried out with the first clearance CL1 being 0.2 to 0.4 mm. This clearance also contributes to surge limitation expansion toward the lower flow rate range without deteriorating the efficiency.

Since the abradable layer is an expensive member, use of the abradable layer in the range of m/M=0.2 to 0.4 contributes to cost reduction if compared with the structure with m/M=0.

The illustrated and described centrifugal compressors are disclosed in Japanese Patent Application Nos. 10-235535 and 10-339698 filed on Aug. 21, 1998 and Nov. 30, 1998 respectively in JPO, and the subject application claims priority of these two Japanese Patent Applications.

What is claimed is:

1. A centrifugal compressor comprising:

a single rotating shaft;

a plurality of impellers mounted on the rotating shaft;

an air path for introducing air accelerated by a first upstream impeller to subsequent downstream impellers;

a casing for accommodating the plurality of impellers and for rotatable supporting the rotating shaft; and an abradable layer embedded in the casing such that it faces the subsequent impellers and is cut by these impellers rotating in the casing, wherein the plurality of impellers are the first upstream impeller and a second downstream impeller, these impellers being mounted on the shaft with their backs being opposed to each other, and the abradable layer being provided for the downstream impeller only.

2. The centrifugal compressor as defined in claim 1, wherein the rotating shaft is supported in the casing such that it is slidable relative to the casing in an axial direction of the rotating shaft within a predetermined range.

3. The centrifugal compressor as defined in claim 2, wherein the predetermined range is about 0.2 mm in length.

4. The centrifugal compressor as defined in claim 2 further including a pinion mounted on the rotating shaft, a large gear in engagement with the pinion, and a drive motor for activating the large gear.

5. The centrifugal compressor as defined in claim 1 further including an inducer block which defines an intake air path for a downstream impeller, and wherein the abradable layer is provided at a front end of the inducer block.

6. The centrifugal compressor as defined in claim 5, wherein the abradable layer is made from Teflon™ mixed with quartz or mica.

7. The centrifugal compressor as defined in claim 1, wherein the abradable layer is made from Teflon™ mixed with quartz or mica.

8. A centrifugal compressor comprising:

a casing defining at least one inner room by its inner wall;

an impeller rotatably housed in each inner room, the impeller having at least one impeller blade; and an abradable layer embedded in each inner wall and subjected to the respective impeller blade, the abradable layer extending in the range of M–m, which M and m satisfy the equation of $0.2 \leqq m/M \leqq 0.4$ where m represents that length of the casing inner wall which corresponds to length of the impeller blade from its front edge to the front edge of the abradable layer, and M represents that length of the casing inner wall which corresponds to length of the impeller blade from the front edge to a rear edge.

9. The centrifugal compressor as defined in claim 8, wherein a certain clearance is formed between the casing inner wall and the impeller blade in a no-abradable-layer area.

10. The centrifugal compressor as defined in claim 9, wherein the certain clearance is about 0.2 to 0.4 mm.

11. The centrifugal compressor as defined in claim 9, wherein there is substantially no clearance between the abradable layer and the impeller blade.

12. The centrifugal compressor as defined in claim 9, wherein the abradable layer projects from the casing inner wall at its upstream end.

13. The centrifugal compressor as defined in claim 8 further including a diffuser downstream of the abradable layer, the diffuser being coplanar to the abradable layer.

14. The centrifugal compressor as defined in claim 8, wherein the abradable layer projects from the casing inner wall in its upstream end area.

15. The centrifugal compressor as defined in claim 13, wherein the abradable layer projects from the casing inner wall in its upstream end area.

16. The centrifugal compressor as defined in claim 8, wherein the abradable layer is made from Teflon™ mixed with quartz or mica.

17. The centrifugal compressor as defined in claim 15, wherein the abradable layer is made from Teflon™ mixed with quartz or mica.

* * * * *